US011751691B2

(12) United States Patent
Meng et al.

(10) Patent No.: US 11,751,691 B2
(45) Date of Patent: Sep. 12, 2023

(54) SEAT CONNECTING DEVICE WITH ADJUSTABLE BACKREST

(71) Applicant: ANJI DEKA OFFICE SYSTEM CO., LTD., Dipu Town (CN)

(72) Inventors: Zhenlin Meng, Dipu Town (CN); Chiachi Shu, Dipu Town (CN); Bin Zheng, Dipu Town (CN); Wenyuan Pan, Dipu Town (CN); Kun Yang, Dipu Town (CN)

(73) Assignee: Anji Deka Office System Co., Ltd., Dipu Town (CN)

( * ) Notice: Subject to any disclaimer, the term of this patent is extended or adjusted under 35 U.S.C. 154(b) by 99 days.

(21) Appl. No.: 17/623,044

(22) PCT Filed: Jun. 12, 2020

(86) PCT No.: PCT/CN2020/095705
§ 371 (c)(1),
(2) Date: Dec. 27, 2021

(87) PCT Pub. No.: WO2021/237811
PCT Pub. Date: Dec. 2, 2021

(65) Prior Publication Data

US 2022/0225777 A1 Jul. 21, 2022

(30) Foreign Application Priority Data

May 28, 2020 (CN) ..... 202010468052.7
May 28, 2020 (CN) ..... 202020932351.7

(51) Int. Cl.
*A47C 7/44* (2006.01)
*A47C 3/18* (2006.01)

(52) U.S. Cl.
CPC ..... *A47C 7/443* (2013.01); *A47C 7/446* (2013.01); *A47C 3/18* (2013.01)

(58) Field of Classification Search
CPC ..... A47C 7/441; A47C 7/443
USPC ..... 297/298, 301.6, 301.7
See application file for complete search history.

(56) References Cited

U.S. PATENT DOCUMENTS 3,603,640 A * 9/1971 Doerner ..... A47C 1/027 297/300.6 X
3,741,607 A * 6/1973 Cramer ..... A47C 7/443 297/300.5 X
4,123,103 A * 10/1978 Doerner ..... A47C 3/026 297/301.6 X
4,183,581 A * 1/1980 Karrip ..... A47C 1/024 297/301.6 X
4,438,978 A * 3/1984 Arild ..... A47C 7/445 297/302.5 X (Continued)

FOREIGN PATENT DOCUMENTS

CN 203435990 U 2/2014
CN 109106114 A1 1/2019
CN 209252095 U 8/2019

*Primary Examiner* — Rodney B White
(74) *Attorney, Agent, or Firm* — Olive Law Group, PLLC

(57) ABSTRACT

Embodiments provide a seat connecting device with an adjustable backrest, belonging to the technical field of swivel chairs. In the embodiments, the seat connecting device includes a seat back tightness control assembly including a control handle, a universal joint, a transmission rod, a first bevel gear, a second bevel gear, a lifting part, a mounting seat of the lifting part, and a tightness adjust rod.

12 Claims, 8 Drawing Sheets

(56) References Cited

U.S. PATENT DOCUMENTS

| | | | | |
|---|---|---|---|---|
| 4,720,142 | A * | 1/1988 | Holdredge | A47C 1/03277 297/301.7 |
| 5,222,783 | A * | 6/1993 | Lai | A47C 1/024 297/301.7 X |
| 5,328,242 | A * | 7/1994 | Steffens | A47C 1/027 297/313 X |
| 6,039,398 | A * | 3/2000 | Gorgi | A47C 1/025 297/301.4 |
| 6,213,552 | B1 * | 4/2001 | Miotto | A47C 1/03272 297/300.7 X |
| 6,450,577 | B1 * | 9/2002 | Roslund, Jr. | A47C 1/03272 297/301.7 |
| 6,598,936 | B1 * | 7/2003 | Klein | A47C 1/026 297/301.5 |
| 7,017,992 | B2 * | 3/2006 | Stumpf | A47C 1/027 297/301.7 |
| 7,784,870 | B2 * | 8/2010 | Machael | A47C 1/03272 297/301.7 |
| 10,813,458 | B2 * | 10/2020 | Moreschi | A47C 7/58 |
| 2012/0025578 | A1 * | 2/2012 | Cvek | F16H 25/18 297/354.1 X |
| 2012/0032484 | A1 * | 2/2012 | Cvek | A47C 1/0242 297/354.1 |
| 2013/0113249 | A1 * | 5/2013 | Cvek | A47C 31/00 297/217.2 |
| 2016/0174720 | A1 * | 6/2016 | Sander | A47C 3/0251 297/303.4 |
| 2016/0309902 | A1 * | 10/2016 | Donati | A47C 1/03266 |
| 2018/0213939 | A1 * | 8/2018 | Schmidt | A47C 3/12 |
| 2018/0279785 | A1 * | 10/2018 | Moreschi | A47C 3/0255 |
| 2020/0178693 | A1 * | 6/2020 | Moreschi | A47C 1/03272 |

* cited by examiner

SEAT CONNECTING DEVICE WITH ADJUSTABLE BACKREST

CROSS REFERENCE TO RELATED APPLICATIONS

This application claims priority to PCT International Patent Application PCT/CN2020/095705, filed Jun. 12, 2020, which claims priority to Chinese Patent Application No. 2020104680527, dated May 28, 2020 and Chinese Patent Application No. 2020209323517, dated May 28, 2020, the disclosures of which are herein incorporated by reference in their entireties.

TECHNICAL FIELD

The present disclosure relates to a seat connecting device with an adjustable backrest, which belongs to the technical field of swivel chairs.

BACKGROUND

The swivel chair is a common office chair, which has the advantages of flexible rotation and flexible movement, and also has the function of convenient adjustment of the height of the chair seat, people can lean or lie down to rest after office work. This common swivel chair cannot meet people's needs because it does not have the function of an adjustable backrest. Therefore, the market urgently needs a chair capable of adjusting the tilt angle of the seat back.

The Chinese patent application with Publication No. CN10933798A discloses a wire control device for adjusting a tilt and tightness (elasticity) of the seat back frame. It includes a back frame tilt adjustment wire control device and a back frame tightness adjusting wire control device arranged in the seat. The back frame tilt adjustment wire control device includes a back frame connection tail plate for connecting the seat back frame, a tilt adjustment mechanism capable to be connected to the back frame connection tail plate, a tilt rope and a tilt adjusting handle. One end of the tilt rope is connected with the tilt adjustment mechanism, and the other end is connected with the tilt adjusting handle. The back frame tightness adjusting wire control device includes a tightness adjustment control rod, a first tightness rope, a second tightness rope and an elastic adjustment mechanism. One end of the first tightness rope is connected with the tightness adjustment control rod, and the other end is connected with the tightness adjusting mechanism. One end of the second tightness rope is connected with the tightness adjustment control rod, and the other end is connected with the tightness adjusting mechanism.

In this solution, since the back frame tightness adjusting wire control device mainly adjusts the tightness adjusting threaded rod through the elastic drawing, the tightness adjusting threaded rod itself has a strong pre-tightening force acting or reacting between the seat back and the seat, it needs to provide greater force to adjust it. The amount of force that the elastic drawing can provide is limited; this is not determined by the tensile strength of the elastic drawstring itself. In addition to the tensile strength of the elastic drawstring itself, the strength of the elasticity adjusting mechanism, the strength of the connection between the tightness adjusting mechanism and the elastic drawstring, etc. are also the factors. Usually the tightness adjusting mechanism itself is a more complicated mechanism. It is regulated by two-direction ropes that are wound on the lifter and rotated in two directions to make it rotate forward and backward. Then the required force is even greater, which further affects the adjustment of the tightness adjusting threaded rod of the back frame tightness adjusting wire control device.

SUMMARY

The present disclosure is intended to provide a seat connecting device with an adjustable backrest, so as to solve the above-mentioned technical problems.

The technical solutions of the present disclosure to solve the above-mentioned problems are as follows:

A seat connecting device with an adjustable backrest, comprising a tray for connecting a gas spring; and a seat connector for installing a chair cushion, the seat connector being fixedly or movably connected to the tray;

the tray has a first hinge point and a second hinge point; the seat connecting device further comprises a seat back connector, one end of the seat back connector is a first hinge part, and an other end of the seat back connector is a free part for installing a backrest of a chair; an upper end of a middle part of the seat back connector is further provided with a second hinge part; the first hinge part is hinged to the first hinge point of the tray, the second hinge part is hinged to the second hinge point through a link and a triangular adjuster; the link has a first end and a second end, the triangular adjuster has a first hinge site at a top part, a second hinge site at a front end of the lower part, and a third hinge site at a rear end of the lower part that are respectively distributed in a triangle shape; the second hinge part is connected to the first end of the link, the second end of the link is hinged to the first hinge site of the triangular adjuster, and the second hinge site of the triangular adjuster is hinged to the second hinge point of the tray;

the seat connecting device further comprises a seat back tightness control assembly comprising a control handle that performs control by rotation, a universal joint, a transmission rod, a first bevel gear, a second bevel gear, a lifter, a mounting seat of the lifter and a tightness adjust rod;

the first bevel gear has a first bevel tooth part and a mounting part; the mounting part is fixedly connected to one end of the transmission rod, and an other end of the transmission rod is fixedly connected to a first end of the universal joint, and a second end of the universal joint is fixedly connected to the control handle;

the second bevel gear has a second bevel tooth part and a flat tooth part; the second bevel tooth part is engaged with the first bevel tooth part;

the lifter has a gear part, a thread part and a bearing part; the flat tooth part is engaged with the gear part of the lifter; the lifter is mounted on the mounting seat in a liftable manner through the thread part thereof;

one end of the tightness adjust rod is fixedly connected to a crossbar, and an other end is provided in the tray; a middle part of the crossbar is carried on the bearing part, two ends of the crossbar are respectively hinged with the third hinge site of the triangular adjuster through a first hinge arm and a second hinge arm; and the crossbar is hingedly provided adjacent to the second hinge point.

In a preferred embodiment, the seat connecting device further comprises a seat back tilt control assembly, the seat back tilt control assembly comprises a connecting plate fixedly connected to the seat back connector, a tilt adjuster, a tilt rope and a tilt adjusting handle; one end of the tilt rope is connected with the tilt adjuster, and an other end is connected with the tilt adjusting handle; the seat back tilt control assembly further comprises a tilt adjuster mounting seat;

the connecting plate has a plurality of rows of holes;

the tilt adjuster has movable bolts that can be inserted into or pulled out of the plurality of rows of holes, and an actuator that controls the movable bolts to be inserted or pulled out; the actuator has a connecting end for fixed connection with one end of the tilt rope, and a control part for controlling states of the movable bolts and being connected in cooperation therewith; an other end of the rope is fixedly connected to the tilt adjusting handle; the tilt adjuster further comprises a first return spring that acts on the actuator and produces a return effect when the movable bolts are controlled by the actuator.

In a preferred embodiment, the seat connecting device further comprises a lifting adjust assembly, and the lifting adjust assembly comprises a lifting handle, a lifting rope, a gas spring paddle and a paddle mounting seat; the gas spring paddle comprises a hinge part for mounting the gas spring paddle on the paddle mounting seat and a toggle portion for controlling the gas spring; one end of the lifting rope is fixedly connected to the gas spring paddle, for controlling states of the gas spring paddle, an other end is connected with the lifting handle; the lifting adjust assembly further comprises a second return spring or a return elastic piece that acts on the gas spring paddle and produces a return effect when the gas spring is controlled by the gas spring paddle.

In a preferred embodiment, the seat connecting device further comprises a seat adjusting assembly, and the seat adjusting assembly comprises a control handwheel, a regulating gear and a regulating rack installed on the seat connector; the regulating gear and the regulating rack are connected in cooperation, and the regulating rack is fixedly connected with respect to the tray.

In a preferred embodiment, the seat adjusting assembly further comprises a limit housing that restricts a rotation of the control handwheel and a transmission bar; the control handwheel has a grip section, a control section and a positioning section that are provided in a step manner, and the grip section is provided outside, the control section is provided in a center, and the positioning section is provided inside; an outer sidewall of the control section is provided with a plurality of rotation limit protrusion bars that are axially provided and arrayed, an inner wall of the limit housing is provided with a plurality of rotation limit grooves that are axially provided and arrayed, the rotation limit protrusion bars and the rotation limit grooves are connected in cooperation; the transmission bar has an inner and an outer ends, the inner end is fixedly connected with the regulating gear, and the outer end is axially sliding sleeved with the control handwheel; the seat adjusting assembly further comprises a positioning steel ball, a positioning spring and a steel ball guide sleeve, the positioning steel ball is elastically and telescopically provided on the steel ball guide sleeve through the positioning spring; the outer sidewall of the positioning section of the control handwheel is provided with a plurality of positioning grooves with different positions in an axial direction, and the positioning steel ball elastically abuts the positioning groove for a connection in cooperation.

In a preferred embodiment, the outer end of the transmission bar is further provided with a limit end for limiting the control handwheel from escaping due to slipping.

In a preferred embodiment, the seat adjusting assembly further comprises a shaft sleeve, and the shaft sleeve is provided between the limit housing and the transmission bar, the transmission bar is rotatably connected with respect to the limit housing through the shaft sleeve.

The present disclosure has the following beneficial effects:

1. The adjustment of seat back tightness according to the present disclosure means the size of force required to adjust the seat back when people need to adjust the tilt angle of the seat back. For example, the larger the required force, the tighter the seat back; the smaller the required force, the looser the seat back. The required tightness of the seat back is related to the user's body type, so different users often need to adjust the tightness of the seat back appropriately. The present disclosure adopts the universal joint to replace the original draw rope for transmission, which improves the response timeliness of the force transmission of the product when adjusting the seat back elasticity; also improves the accuracy and controllability of the seat back elasticity adjustment. At the same time, relative to the use of pull-rope adjustment method, it also effectively improves the size of the force arm, improves the size of the force transmission of the product during adjustment, improves the demand for the size of the force transmission, reduces the force requirements for the user, and effectively reduces the possibility of damage to the adjustment mechanism due to excessive input force when the product is adjusted, thereby increasing the service life of the product.
2. The seat back tilt adjustment of the present disclosure means the adjustment of the tilt angle of the seat back when people use the chair; and the seat back tilt control assembly of the present disclosure means the assembly that controls the tilt adjustment of the seat back, that is, controls whether the seat back can be adjusted. When the seat back is in a non-adjusting state, it can also determine what tilt angle the seat back is in. The present disclosure uses a connecting plate with a plurality of rows of holes, a tilt adjuster, a tilt rope and a tilt adjusting handle to perform tilt control and adjustment of the seat back, which is different from the above-mentioned seat back tightness control assembly that needs to be adjusted by a larger driving force. The seat back tilt control assembly is equivalent to being a control switch, and it can be controlled with only a small force, so it adopts the tilt rope as a control medium. The structure is simple, with convenient use;
3. The lifting adjustment of the present disclosure means the adjustment of the height of the seat when people use the chair. The lifting adjustment of the present disclosure is implemented on the basis of the use of gas springs; the lifting rope is controlled by the lifting handle, and then the gas spring paddle is controlled. Whether the gas spring paddle presses the control point of the gas spring or not, usually external force is used to adjust the extension of the movable part of the gas spring. Similarly, the lifting adjust assembly according to the present disclosure is equivalent to exist as a control switch, which can be controlled with only a small force, so the lifting rope is used as the control medium, which has the characteristics of simple structure and convenient use;
4. The seat adjustment of the present disclosure means the adjustment of the amount of extension of the seat in the horizontal direction with reference to the direction directly in front of the user when people use the chair. This adjustment also has a greater impact on the comfort of the chair. If the user is a child, a smaller extension is usually required; if the user is an adult, a larger extension is usually required. In the present disclosure, a control handwheel, a transmission bar, and a regulating gear and the regulating rack are adopt to adjust the extension of the seat, and to limit the rotation direction of the control handwheel through the limit housing, so that the control handwheel will not rotate due to accidental touch when in a non-adjusting state. When adjustment is required, the control handwheel is pulled out slightly to release the limit of the control handwheel by the limit housing. At this time, the extension of the chair seat can be adjusted by turning the control handwheel. In order to prevent the control handwheel from being pulled out into an adjustable state due to accidental touch when the control handwheel is in the non-adjusting state, the present disclosure also sets up a structure of a positioning steel ball, a positioning spring and a steel ball guide sleeve. The control handwheel can be prevented from being pulled out due to accidental touch by that the positioning section inside the control handwheel is elastically pressed against by the positioning steel ball.

The reference signs are explained as follows:

1-tray; 2-seat connector; 3-seat back connector; 4-link; 5-triangular adjuster, 6-seat back tightness control assembly; 7*a*-first hinge arm; 7*b*-second hinge arm; 8-seat back tilt control assembly; 9-lifting adjust assembly, 10-seat adjusting assembly;

11-first hinge point; 12-second hinge point;

31-first hinge part; 32-second hinge part; 33-free part;

4*a*-first end of the link; 4*b*-second end of the link;

51-first hinge site; 52-second hinge site; 53-third hinge site;

61-control handle of seat back tightness control assembly; 62-universal joint; 63-transmission rod; 64-first bevel gear; 65-second bevel gear; 66-lifter; 67-mounting seat of the lifter; 68-tightness adjust rod; 69-crossbar;

64*a*-first bevel tooth part; 64*b*-mounting part;

65*a*-second bevel tooth part; 65*b*-flat tooth part;

66*a*-gear part; 66*b*-thread part; 66*c*-bearing part;

81-connecting plate; 82-tilt adjuster, 83-tilt rope; 84-tilt adjusting handle; 85-tilt adjuster mounting seat;

81*a*-plurality of rows of holes;

82.1-movable bolt, 82.2-actuator, 82.3-first return spring;

82.2*a*-connecting end, 82.2*b*-control part;

91-lifting handle, 92-lifting rope, 93-gas spring paddle, 94-paddle mounting seat;

101-control handwheel, 102-regulating gear, 103-regulating rack;

101.1-grip section, 101.2-control section, 101.3-positioning section;

104.1-limit housing, 104.2-transmission bar, 104.3-limit end, 105.1-positioning steel ball, 105.2-positioning spring, 105.3-steel ball guide sleeve, 106-shaft sleeve.

DESCRIPTION OF EMBODIMENTS

The present disclosure will be further explained below in combination with the accompanying drawings of the specification.

The present specific embodiment is only an explanation of the present disclosure, not a limitation of the present disclosure. Any changes made by those skilled in the art after reading the specification of the present disclosure will be protected by the patent law as long as they fall within the scope of the claims.

Figure 1:
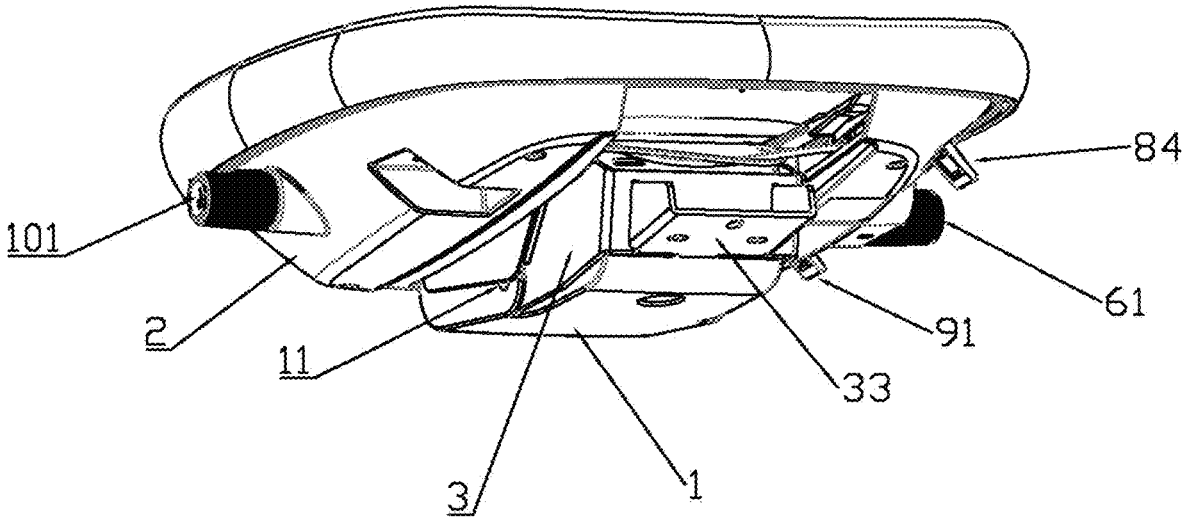
FIG. 1 is a schematic diagram illustrating the three-dimensional structure of the present disclosure.

As shown in FIG. 1, a seat connecting device with an adjustable backrest may include a tray 1 for connecting a gas spring, a seat connector 2 for installing a seat cushion, a seat back connector 3, a seat back tightness (elasticity) control assembly 6, a seat back tilt control assembly 8, a lifting adjust assembly 9 and a seat adjusting assembly 10. The seat connector 2 may be fixedly connected with the tray 1.

Figure 3:
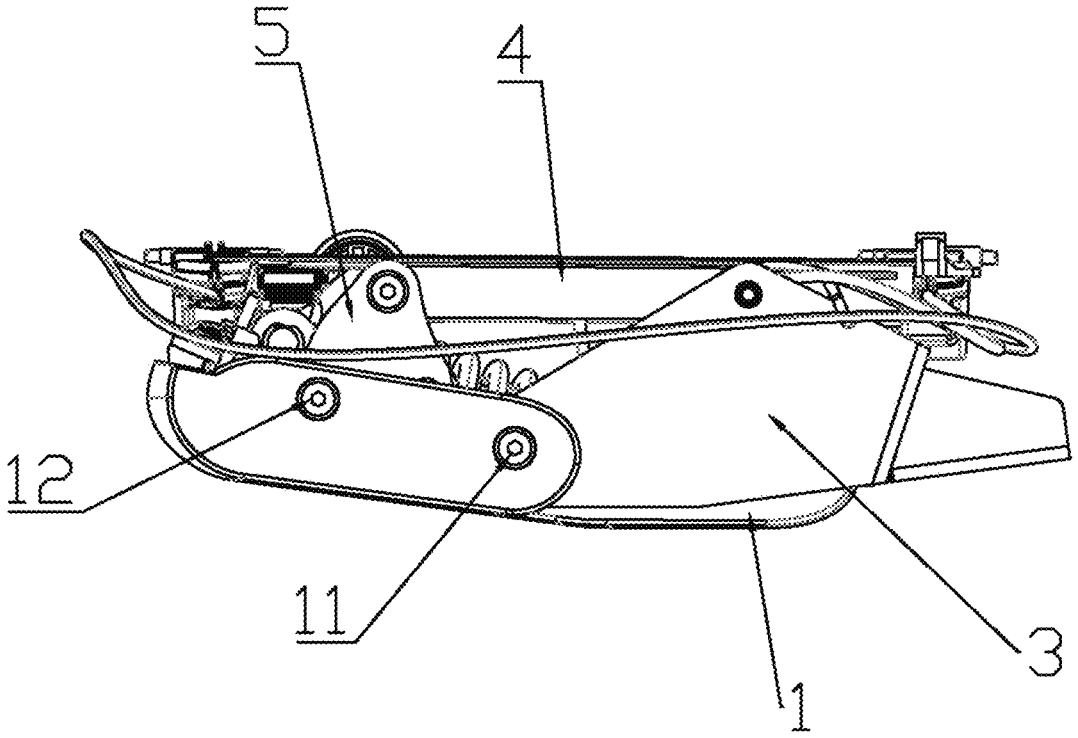
FIG. 3 is a side view of the present disclosure with the seat connector removed.

As shown in FIG. 3, the tray 1 may be provided with a first hinge point 11 and a second hinge point 12.

Figure 4:
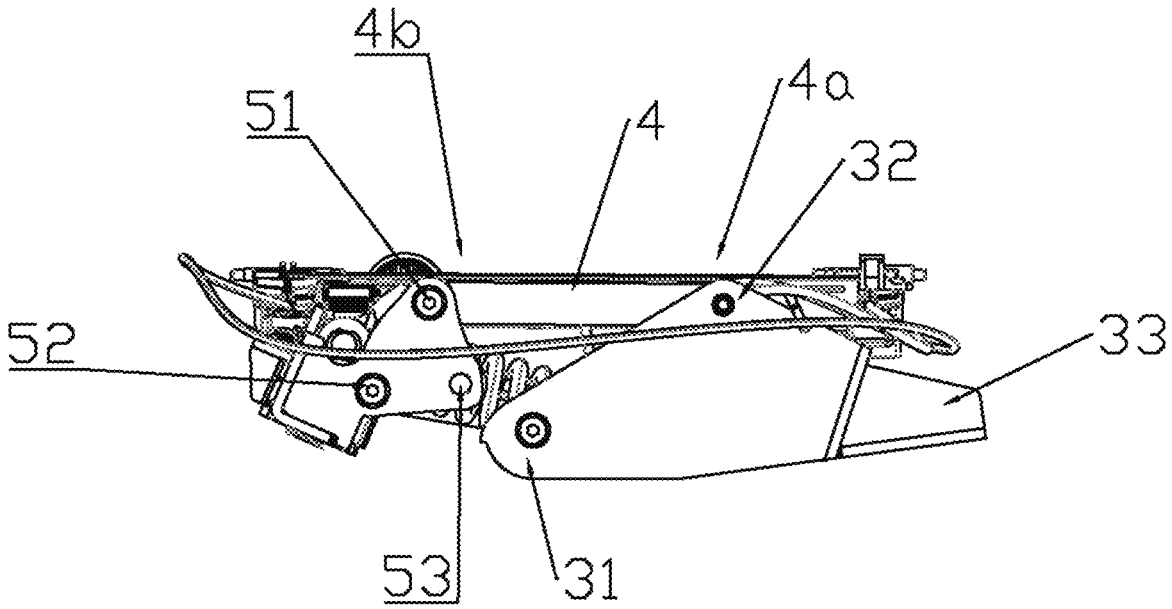
FIG. 4 is a side view of the present disclosure with the seat connector and the tray removed.

As shown in FIG. 4, one end of the seat back connector 3 may be a first hinge part 31, and the other end may be a free part 33 for mounting the backrest of the chair, and an upper end of the middle part of the seat back connector 3 may be also provided with a second hinge part 32.

Referring to FIGS. 3 and 4, the first hinge part 31 may be hinged to the first hinge point 11. The second hinge part 32 may be hinged with the second hinge point 12 through a link 4 and a triangular adjuster 5. The link 4 may be provided with a first end 4*a* and a second end 4*b*. The triangular adjuster 5 may be provided with a first hinge site 51 at the top, a second hinge site 52 at the front end of the lower part, and a third hinge site 53 at the rear end of the lower part respectively distributed in a triangle shape. The second hinge part 32 may be hinged to the first end 4*a* of the link 4, the second end 4*b* of the link may be hinged to the first hinge site 51 of the triangular adjuster 5, and the second hinge site 52 of the triangular adjuster 5 may be hinged to the second hinge point 12 of the tray 1.

Figure 2:
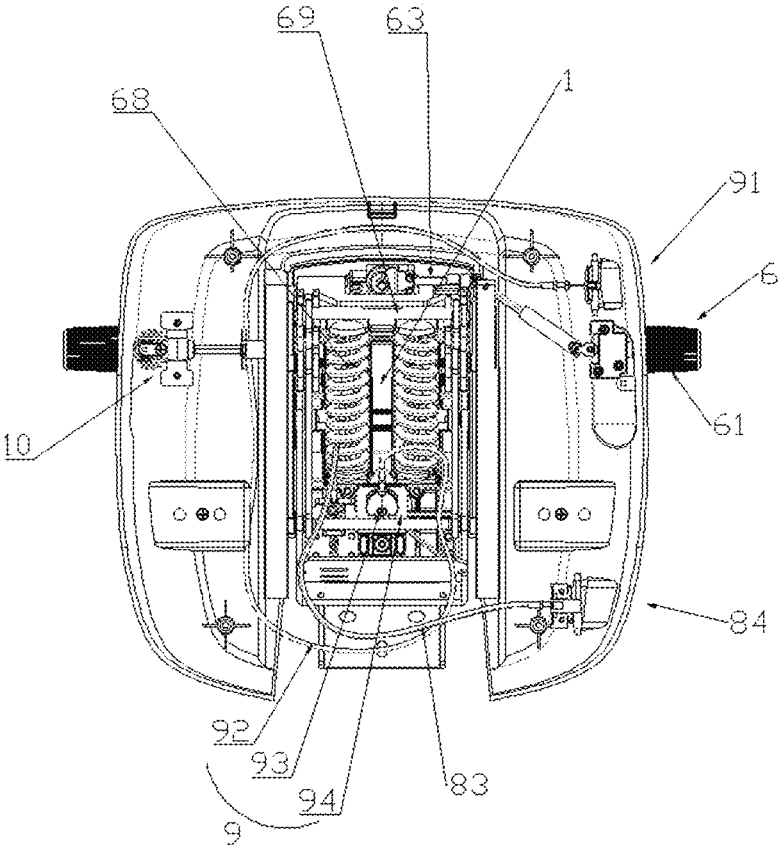
FIG. 2 is a top view of the present disclosure.
Figure 5:
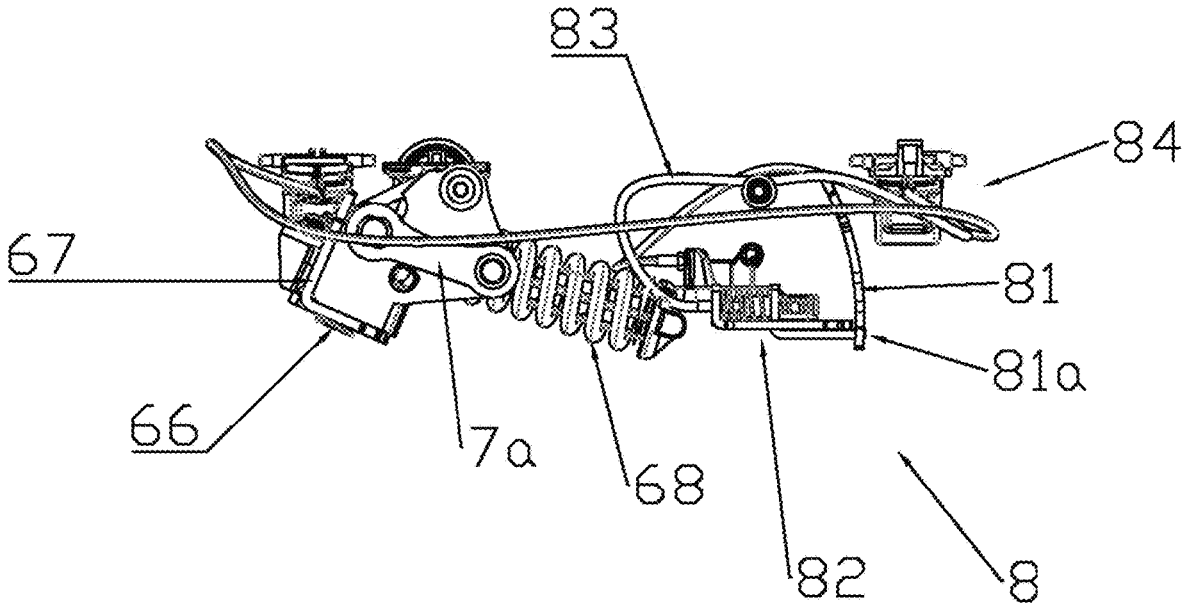
FIG. 5 is a side view of the present disclosure with the seat connector, the tray and the seat back connector removed.
Figure 7:
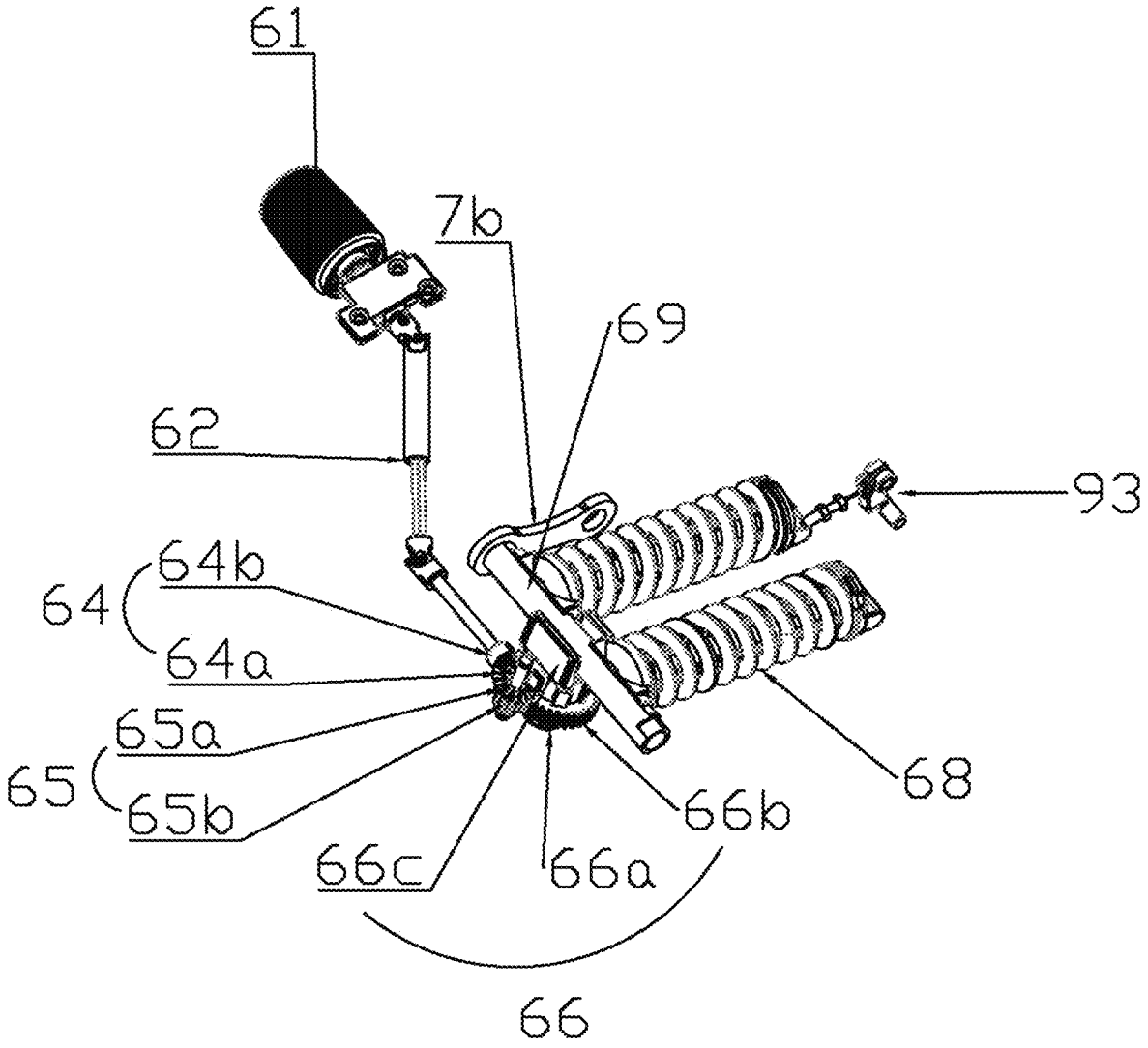
FIG. 7 is a schematic view of the three-dimensional structure of the seat back tightness adjusting control assembly of the present disclosure.

As shown in FIG. 2, FIG. 5 and FIG. 7, the seat back tightness control assembly 6 may include a control handle 61 that is adjusted in a rotating manner, a universal joint 62, a transmission rod 63, a first bevel gear 64, a second bevel gear 65, a lifter 66, a mounting seat 67 of the lifter, and a tightness adjust rod 68. The first bevel gear 64 may have a first bevel tooth part 64*a* and a mounting part 64*b*. The mounting part 64*b* may be fixedly connected to one end of the transmission rod 63, and the other end of the transmission rod 63 may be fixedly connected to the first end 62*a* of the universal joint, the second end 62*b* of the universal joint may be fixedly connected with the control handle 61. The second bevel gear 65 may have a second bevel tooth part 65*a* and a flat tooth part 65*b*. The second bevel tooth part 65*a* may be engaged with the first bevel tooth part 64*a*. The lifter 66 may have a gear part 66*a*, a thread part 66*b*, and a bearing part 66*c*. The flat tooth part 65*b* may be engaged with the gear part 65*a* of the lifter 66. The lifter 66 can be installed on the mounting seat 67 through its thread part 66*b* in a liftable manner. One end of the tightness adjust rod 68 may be fixedly connected to a crossbar 69, and the other end may be provided in the tray 1. The middle part of the crossbar 69 may be carried on the bearing part 66*c*, two ends thereof may be hinged to the third hinge site 53 of the triangular adjuster 5 through a first hinge arm 7*a* and a second hinge arm 7*b*; and the crossbar 69 may be hingedly provided adjacent to the second hinge point 12.

Figure 6:
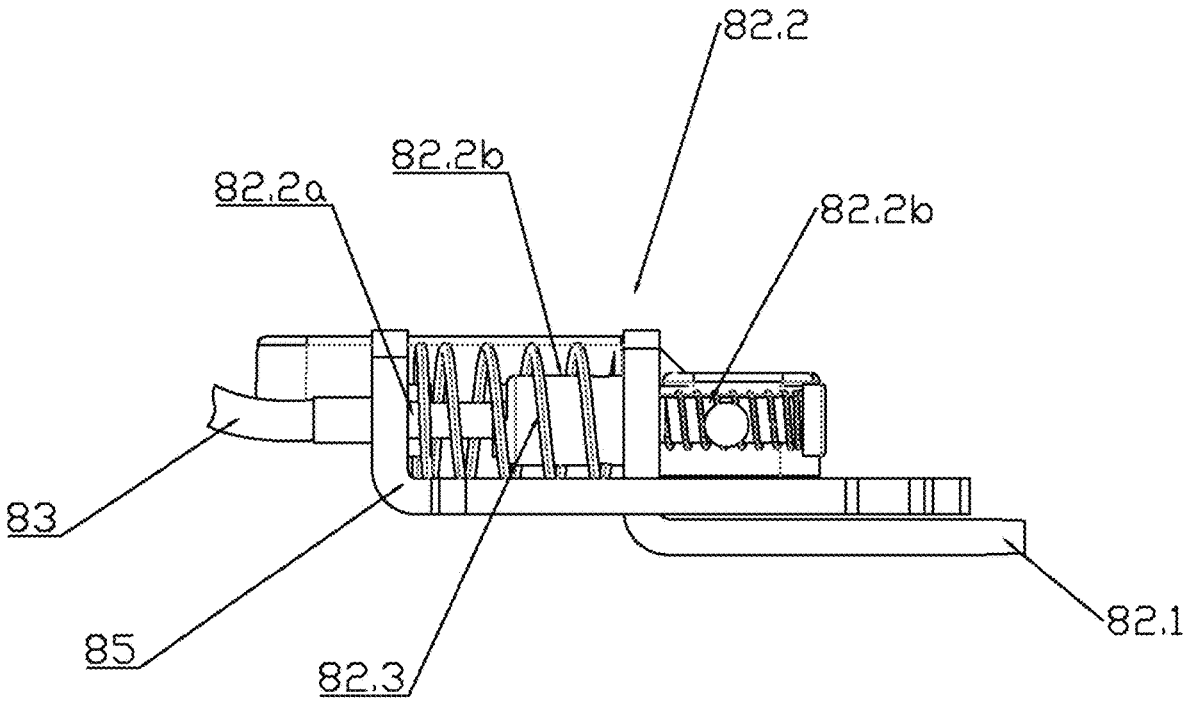
FIG. 6 is a partial enlarged view of FIG. 5.

As shown in FIGS. 2, 5 and 6, the seat back tilt control assembly 8 may include a connecting plate 81 fixedly connected to the seat back connector 3, a tilt adjuster 82, a tilt rope 83 and a tilt adjusting handle 84. One end of the tilt rope 83 may be connected with the tilt adjuster, and the other end may be connected with the tilt adjusting handle 84. The seat back tilt control assembly 8 may also include a tilt adjuster mounting seat 85. The connecting plate 81 may be provided with a plurality of rows of holes 81*a*; the tilt adjuster 82 may be provided with a plurality of movable bolts 82.1 for inserting or detaching from the plurality of rows of holes 81*a*, and an actuator 82.2 for controlling the inserting or detaching of the movable bolts 82.1. The actuator 82.2 may have a connecting end 82.2*a* for being fixedly connected to one end of the tilt rope 83 and a control part 82.2*b* for controlling the state of the movable bolt 82.1 and connected therewith in cooperation. The other end of the rope 83 may be fixedly connected to the tilt adjusting handle 84; the tilt adjuster 82 may also include a first return spring 82.3 that acts on the actuator 82.2 and produces a return effect when the movable bolt 82.1 is controlled by the actuator 82.2.

As shown in FIGS. 2 and 7, the lifting adjust assembly 9 may include a lifting handle 91, a lifting rope 92, a gas spring paddle 93 and a paddle mounting seat 94. The gas spring paddle 93 may include a hinge part that install the gas spring paddle to the paddle mounting seat, and a toggle part for controlling the gas spring. One end of the lifting rope 92 may be fixedly connected to the gas spring paddle 93 for controlling the state of the gas spring paddle 93, and the other end may be connected to the lifting handle 91. The lifting adjust assembly 9 may also include a second return spring that acts on the gas spring paddle 93 and produces a return effect when controlling the gas spring.

As shown in FIGS. 1 and 2, the seat adjusting assembly 10 may include a control handwheel 101, a regulating gear 102, and a regulating rack 103 installed on the seat connector 2. The regulating gear 102 and the regulating rack 103 may be connected in cooperation, and the regulating rack 103 may be fixedly connected to the tray 1.

Figure 8:
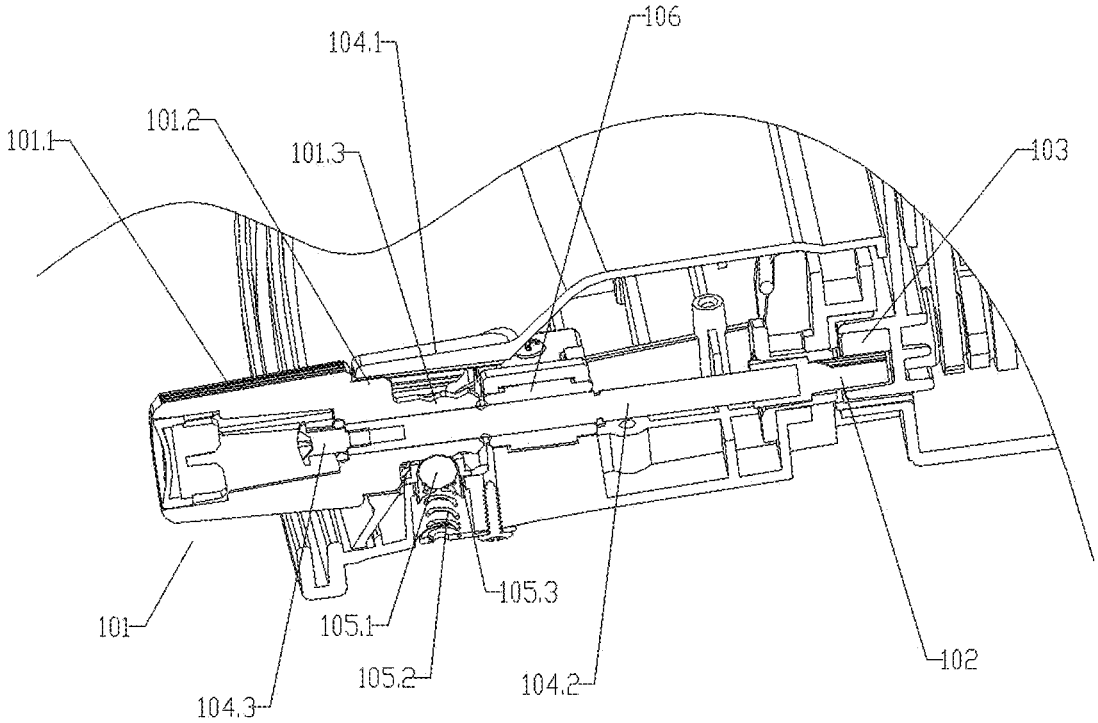
FIG. 8 is a schematic structural view of the seat adjusting assembly of the present disclosure.

As shown in FIG. 8, the seat adjusting assembly 10 may further include a limit housing 104.1 that restricts the rotation of the control handwheel, and a transmission bar 104.2. The control handwheel 101 may have a grip section 101.1, a control section 101.2 and a positioning section 101.3 that are provided in a stepped manner. The grip section 101.1 may be provided outside, the control section 101.2 may be provided in the center, and the positioning section 101.3 may be provided inside. The outer sidewall of the control section 101.2 may be provided with a plurality of rotation limit protrusion bars that are axially provided and arrayed, an inner wall of the limit housing 104.1 may be provided with a plurality of rotation limit grooves that are axially provided and arrayed, the rotation limit protrusion bars and the rotation limit grooves may be connected in cooperation. The transmission bar 104.2 may have an inner and an outer ends, the inner end is fixedly connected with the regulating gear 102, and the outer end is axially sliding sleeved with the control handwheel 101. The seat adjusting assembly 10 may further include a positioning steel ball 105.1, a positioning spring 105.2 and a steel ball guide sleeve 105.3. The positioning steel ball 105.1 may be elastically and telescopically provided on the steel ball guide sleeve 105.3 through the positioning spring 105.2. The outer sidewall of the positioning section 101.3 of the control handwheel 101 may be provided with a plurality of positioning grooves with different positions in an axial direction, and the positioning steel ball 105.1 elastically abuts the positioning groove for a connection in cooperation. The seat adjusting assembly 10 may further include a shaft sleeve 106, and the shaft sleeve 106 may be provided between the limit housing 104.1 and the transmission bar 104.2. The transmission bar 104.2 may be rotatably connected with respect to the limit housing 104.1 through the shaft sleeve 106.

What is claimed is:

1. A seat connecting device with an adjustable backrest, comprising a tray for connecting a gas spring; and a seat connector for installing a chair cushion, the seat connector being fixedly or movably connected to the tray;

wherein:

the tray has a first hinge point and a second hinge point; the seat connecting device further comprises a seat back connector, a first end of the seat back connector is a first hinge part, and a second end of the seat back connector is a free part for installing a backrest of a chair; an upper end of a middle part of the seat back connector is further provided with a second hinge part; the first hinge part is hinged to the first hinge point of the tray, the second hinge part is hinged to the second hinge point through a link and a triangular adjuster; the link has a first end and a second end, the triangular adjuster has a first hinge site at a top part, a second hinge site at a front end of the lower part, and a third hinge site at a rear end of the lower part that are respectively distributed in a triangle shape; the second hinge part is connected to the first end of the link, the second end of the link is hinged to the first hinge site of the triangular adjuster, and the second hinge site of the triangular adjuster is hinged to the second hinge point of the tray;

the seat connecting device further comprises a seat back tightness control assembly comprising a control handle that performs control by rotation, a universal joint, a transmission rod, a first bevel gear, a second bevel gear, a lifter, a mounting seat the lifter and a tightness adjust rod;

the first bevel gear has a first bevel tooth part and a mounting part; the mounting part is fixedly connected to a first end of the transmission rod, and a second end of the transmission rod is fixedly connected to a first end of the universal joint, and a second end of the universal joint is fixedly connected to the control handle;

the second bevel gear has a second bevel tooth part and a flat tooth part; the second bevel tooth part is engaged with the first bevel tooth part;

the lifter has a gear part, a thread part and a bearing part; the flat tooth part is engaged with the gear part of the lifter; the lifter is mounted on the mounting seat in a liftable manner through the thread part of the lifter;

a first end of the tightness adjust rod is fixedly connected to a crossbar, and another end is provided in the tray; a middle part of the crossbar is carried on the bearing part, two ends of the crossbar are respectively hinged with the third hinge site of the triangular adjuster through a first hinge arm and a second hinge arm; and the crossbar is hingedly provided adjacent to the second hinge point.

2. The seat connecting device with an adjustable backrest according to claim 1, wherein: the seat connecting device further comprises a seat back tilt control assembly, the seat back tilt control assembly comprises a connecting plate fixedly connected to the seat back connector, a tilt adjuster, a tilt rope and a tilt adjusting handle; a first end of the tilt rope is connected with the tilt adjuster, and a second end is connected with the tilt adjusting handle; the seat back tilt control assembly further comprises a tilt adjuster mounting seat;

the connecting plate has a plurality of rows of holes;

the tilt adjuster has movable bolts that can be inserted into or pulled out of the plurality of rows of holes, and an actuator that controls the movable bolts to be inserted or pulled out;

the actuator has a connecting end for fixed connection with a first end of the tilt rope, and a control part for controlling states of the movable bolts and being connected in cooperation therewith; a second end of the rope is fixedly connected to the tilt adjusting handle; the tilt adjuster further comprises a first return spring that acts on the actuator and produces a return effect when the movable bolts are controlled by the actuator.

3. The seat connecting device with an adjustable backrest according to claim 2, wherein: the seat connecting device further comprises a lifting adjust assembly, and the lifting adjust assembly comprises a lifting handle, a lifting rope, a gas spring paddle and a paddle mounting seat; the gas spring paddle comprises a hinge part for mounting the gas spring paddle on the paddle mounting seat and a toggle portion, for controlling the gas spring; a first end of the lifting rope is fixedly connected to the gas spring paddle for controlling states of the gas spring paddle, a second end is connected with the lifting handle; the lifting adjust assembly further comprises a second return spring or a return elastic piece that acts on the gas spring paddle and produces a return effect when the gas spring is controlled by the gas spring paddle.

4. The seat connecting device with an adjustable backrest according to claim 2, wherein: the seat connecting device further comprises a seat adjusting assembly, and the seat adjusting assembly comprises a control handwheel, a regulating gear and a regulating rack installed on the seat connector; the regulating gear and the regulating rack are connected in cooperation, and the regulating rack is fixedly connected with respect to the tray.

5. The seat connecting device with an adjustable backrest according to claim 4, wherein: the seat adjusting assembly further comprises a limit housing that restricts a rotation of the control handwheel and a transmission bar; the control handwheel has a grip section, a control section and a positioning section that are provided in a step manner, and the grip section is provided outside, the control section is provided in a center, and the positioning section is provided inside; an outer sidewall of the control section is provided with a plurality of rotation limit protrusion bars that are axially provided and arrayed, an inner wall of the limit housing is provided with a plurality of rotation limit grooves that are axially provided and arrayed, the rotation limit protrusion bars and the rotation limit grooves are connected in cooperation; the transmission bar has an inner and an outer ends, the inner end is fixedly connected with the regulating gear, and the outer end is axially sliding sleeved with the control handwheel; the seat adjusting assembly further comprises a positioning steel ball, a positioning spring and a steel ball guide sleeve, the positioning steel ball is elastically and telescopically provided on the steel ball guide sleeve through the positioning spring; the outer sidewall of the positioning section of the control handwheel is provided with a plurality of positioning grooves with different positions in an axial direction, and the positioning steel ball elastically abuts the positioning groove for a connection in cooperation.

6. The seat connecting device with an adjustable backrest according to claim 5, wherein: the outer end of the transmission bar is further provided with a limit end for limiting the control handwheel from escaping due to slipping.

7. The seat connecting device with an adjustable backrest according to claim 5, wherein: the seat adjusting assembly further comprises a shaft sleeve, and the shaft sleeve is provided between the limit housing and the transmission bar, the transmission bar is rotatably connected with respect to the limit housing through the shaft sleeve.

8. The seat connecting device with an adjustable backrest according to claim 1, wherein: the seat connecting device further comprises a lifting adjust assembly, and the lifting adjust assembly comprises a lifting handle, a lifting rope, a gas spring paddle and a paddle mounting seat; the gas spring paddle comprises a hinge part for mounting the gas spring paddle on the paddle mounting seat and a toggle portion, for controlling the gas spring; one end of the lifting rope is fixedly connected to the gas spring paddle for controlling states of the gas spring paddle, a second end is connected with the lifting handle; the lifting adjust assembly further comprises a second return spring or a return elastic piece that acts on the gas spring paddle and produces a return effect when the gas spring is controlled by the gas spring paddle.

9. The seat connecting device with an adjustable backrest according to claim 1, wherein: the seat connecting device further comprises a seat adjusting assembly, and the seat adjusting assembly comprises a control handwheel, a regulating gear and a regulating rack installed on the seat; the regulating gear and the regulating rack are connected in cooperation, and the regulating rack is fixedly connected with respect to the tray.

10. The seat connecting device with an adjustable backrest according to claim 9, wherein: the seat adjusting assembly further comprises a limit housing that restricts a rotation of the control handwheel and a transmission bar; the control handwheel has a grip section, a control section and a positioning section that are provided in a step manner, and the grip section is provided outside, the control section is provided in a center, and the positioning section is provided inside; an outer sidewall of the control section is provided with a plurality of rotation limit protrusion bars that are axially provided and arrayed, an inner wall of the limit housing is provided with a plurality of rotation limit grooves that are axially provided and arrayed, the rotation limit protrusion bars and the rotation limit grooves are connected in cooperation; the transmission bar has an inner and an outer ends, the inner end is fixedly connected with the regulating gear, and the outer end is axially sliding sleeved with the control handwheel; the seat adjusting assembly further comprises a positioning steel ball, a positioning spring and a steel ball guide sleeve, the positioning steel ball is elastically and telescopically provided on the steel ball guide sleeve through the positioning spring; the outer sidewall of the positioning section of the control handwheel is provided with a plurality of positioning grooves with different positions in an axial direction, and the positioning steel ball elastically abuts the positioning groove for a connection in cooperation.

11. The seat connecting device with an adjustable backrest according to claim 10, wherein: the outer end of the transmission bar is further provided with a limit end for limiting the control handwheel from escaping due to slipping.

12. The seat connecting device with an adjustable backrest according to claim 10, wherein: the seat adjusting assembly further comprises a shaft sleeve, and the shaft sleeve is provided between the limit housing and the transmission bar, the transmission bar is rotatably connected with respect to the limit housing through the shaft sleeve.

* * * * *